US009163438B2

(12) United States Patent
Mackay et al.

(10) Patent No.: US 9,163,438 B2
(45) Date of Patent: Oct. 20, 2015

(54) DOOR STAY

(71) Applicant: Maxtech Consumer Products Limited, Waterloo (CA)

(72) Inventors: Timothy Mackay, Kitchener (CA); Olivier Mayrand, Waterloo (CA); Gilles Louis Vachon, Brights Grove (CA)

(73) Assignee: Maxtech Consumer Products Limited, Waterloo, ON (CA)

( * ) Notice: Subject to any disclaimer, the term of this patent is extended or adjusted under 35 U.S.C. 154(b) by 0 days.

(21) Appl. No.: 14/284,735

(22) Filed: May 22, 2014

(65) Prior Publication Data

US 2014/0345083 A1 Nov. 27, 2014

Related U.S. Application Data

(60) Provisional application No. 61/827,315, filed on May 24, 2013.

(51) Int. Cl.
*E05C 17/44* (2006.01)
*E05C 17/54* (2006.01)

(52) U.S. Cl.
CPC ..... *E05C 17/44* (2013.01); *E05C 17/54* (2013.01); *E05C 17/443* (2013.01); *Y10T 16/625* (2015.01)

(58) Field of Classification Search
CPC ..... Y10T 16/61; Y10T 16/625; Y10T 16/628; E05C 17/44; E05C 17/54; E05C 17/443; E05F 5/02; E05F 5/06; E05F 5/08
USPC ..... 16/82, 85, 86 R; 292/342, 343, 338, 292/339, DIG. 15, DIG. 19; D8/402
See application file for complete search history.

(56) References Cited

U.S. PATENT DOCUMENTS

| | | | | | |
|---|---|---|---|---|---|
| 1,533,831 | A | * | 4/1925 | Colchin | 292/239 |
| 1,560,562 | A | * | 11/1925 | Golding | 292/338 |
| 1,875,965 | A | * | 9/1932 | Waters | 292/73 |
| D120,752 | S | * | 5/1940 | Gallinger | D8/330 |
| 2,484,717 | A | * | 10/1949 | Loehr et al. | 292/178 |
| 2,595,709 | A | * | 5/1952 | Sands | 292/339 |
| 2,709,615 | A | * | 5/1955 | Barnes, Jr. et al. | 292/339 |
| 2,739,005 | A | * | 3/1956 | Naffziger | 292/339 |
| 2,941,831 | A | * | 6/1960 | Borsani | 292/79 |
| 2,988,392 | A | * | 6/1961 | Kuo | 292/338 |
| 3,116,946 | A | * | 1/1964 | Deloume | 292/77 |

(Continued)

FOREIGN PATENT DOCUMENTS

CA 2285521 A1 * 4/2001

*Primary Examiner* — William Miller
(74) *Attorney, Agent, or Firm* — Dickinson Wright LLP

(57) ABSTRACT

A door stay for attachment to a door above a floor, the door stay comprising a mounting means, and a floor-contacting element rotatably mounted on said mounting means, the floor-contacting element being biased against said floor by the mounting means. Preferably, the floor-contacting element is a ball and the ball moves over the floor under tension. The door stay provides significant advantages in the positioning of a door so that it will not swing to and fro, but which can still nevertheless be swung open when desired by manual operation of the door. The door stay is attachable to the lower edge of the door, wherever required and removed when no longer required, or when it is required somewhere else. All of these features are provided in a relatively simple low cost door stay which is highly effective in practical use.

5 Claims, 11 Drawing Sheets

(56) References Cited

U.S. PATENT DOCUMENTS

| | | | | | |
|---|---|---|---|---|---|
| 3,129,969 | A | * | 4/1964 | Kuo | 292/338 |
| D268,322 | S | * | 3/1983 | Berkowitz | D8/330 |
| 4,569,546 | A | * | 2/1986 | Howard et al. | 292/336.3 |
| 5,673,952 | A | * | 10/1997 | Chezem et al. | 292/338 |
| 6,120,072 | A | * | 9/2000 | Benedict | 292/338 |
| 7,065,830 | B2 | * | 6/2006 | Bushey | 16/82 |
| D533,447 | S | | 12/2006 | Irie | |
| 7,766,400 | B2 | | 8/2010 | Predebon | |

* cited by examiner

D
12
B
10
15a
15b
17a
17b
A
14b
14a
19b
16b
19a
16a
18
F

DOOR STAY

REFERENCE TO RELATED APPLICATION

This is a formal application based on, and claiming the benefit of, U.S. provisional patent application No. 61/827,315, filed May 24, 2013.

BACKGROUND OF THE INVENTION

The invention relates to a door stay which is easily attachable to a door to provide greater or lesser tension actively and consistently in contact with the floor as the door goes through its full movement regardless of height variations and inconsistencies between the bottom of the door and the floor. The result is that the door is held in any predetermined partially opened position by spring tension, but can be moved to and fro by hand pressure.

A door may typically be swung between open and closed positions. When it is closed the latch is locked and holds the door shut. When the door is open, it is usually free to swing to and fro. Wedges and other devices are available to wedge a door open. However, they have the disadvantage that once wedged the door is immovable until the wedge is released by moving the door away from the wedge. Once the door is released it is free to swing to and fro.

In addition, the positioning and insertion of the wedge usually requires a person to bend over, and this may be inconvenient and tiresome.

Various products have been designed to provide releasable door wedges which can be attached to the bottom of doors, and simply operated by the foot. Such devices again, usually function to hold a door securely in a wedged open position and once released, leave the door free to swing.

It is however, desirable in many situations to provide a door which is held partially open, while rendering the door movable by hand to allow free access to a room. Typically these situations occur in the care of small children, the elderly or persons suffering from some kind of sickness. In these cases it may be desirable to leave the door "ajar", so that if the child or person cries out or moves unexpectedly, the sounds can be heard through the door opening and the care person may react swiftly.

Particularly for example, in the case of child care, it is a common experience for parents or child care persons to simply prop a door open by the use of a shoe or slipper.

These simple homely expedients are however inconvenient and ineffective. In particular, if there is any draft or if there is a wind from an open window the door will swing open and closed and will continually bump against whatever is being used as a door stay. This may awaken a child or irritate a person in a room, and may in itself create a problem for a child care person resting in an adjacent room.

The requirement for a door stay may also arise in many other situations such as bedrooms, bathrooms, offices, kitchens and the like, in all of which situations it may at some time be desirable to leave a door ajar so that it is not fully closed and is not fully open, and is held against random swinging, but is nevertheless rendered movable by hand.

For all of these reasons, it is desirable to provide a form of door stay which engages the floor simply by means of tension and friction. In this way, the door may be held open at any desired position, either being open no more than a few inches, or being swung wider open, and the spring-loaded door stay will hold the door in that position by means of tension and prevent it from being swung to and fro by forces such as drafts and wind.

However, it is clearly further desirable that the tension should not be so great that the door cannot be swung open by hand, by an adult or by a child when it is required.

It is not intended that the door stay should totally prevent movement of the door, and indeed it is considered undesirable that it should do so. It is simply intended that the door stay will prevent uncontrolled swinging of the door in a random fashion.

It is also desirable that the door stay should be capable of being readily attached to a door wherever it is required, and in some cases, it is desirable that it may be readily attached to and detached from the door without the need of special tools and without damaging the door.

It is also desirable that the door stay should be of simple construction without the requirement for special instructions or skill as to installation or use. Further, a desirable characteristic is that the door stay ideally should be moveable readily from one door to another, in at least some embodiments, depending upon the requirements of a particular time or day.

Ease of manufacture, packaging, shipping and sale are also important factors.

There have been designs which have attempted to provide a frictional door stay. These prior designs have failed to address a number of problems. One problem is that using friction and dragging a member over a floor surface can cause damage either to the floor or to the contact mechanism, pulling fibers out of a carpet, for example, or wearing a groove in a carpet or harder floor surface.

Another problem is a failure to address any variation in floor elevation or in the gap between the floor and the bottom of the door as the door is swung. In older houses, this variation can be substantial, but it can also occur in newer houses due to improper installation of the floor resulting in the floor being not level, and/or improper alignment of hinges or casing of the door. Such variations can be a major reason that the door has an unstable position normally and needs a door stay to control it.

SUMMARY OF THE INVENTION

With a view to providing a door stay which is directed towards achieving the major objectives described above while avoiding or mitigating the problems described above, the invention provided a door stay for attachment adjacent to a door above a floor, which comprising a mounting means, and a floor-contacting element flexibly mounted on said mounting means, the floor-contacting element being rotatably mounted in said mounting means and biased against said floor by the mounting means.

In following embodiments of the invention, the floor-contacting element is shown as a ball of resilient thermoplastic material. Those skilled in the art would appreciated that the floor-contacting element can be any rotatable object that can be rotatably mounted on said mounting means. For example, the floor-contacting element can be a cylinder.

In some embodiments of the invention, the biasing of said floor-contacting element against said floor is supplied by a spring and the biasing is adjustable, whereby the degree of friction of the floor-contacting element against said floor may be adjusted.

In some embodiments of the invention, the ball is held on an axle, and when the door stay is mounted on the door, the axle is parallel to within 5 degrees of the door, allowing the ball to rotate freely, In one example, the axle is connected with spring and the spring is attached to the mounting means by a shaft.

In some examples, the mounting means includes a U-shaped clamp.

BRIEF DESCRIPTION OF THE DRAWINGS

The accompanying drawings illustrate several embodiments of the invention, as examples only. Other variations will be apparent to those knowledgeable in the field of the invention.

DETAILED DESCRIPTION

Figure 1:
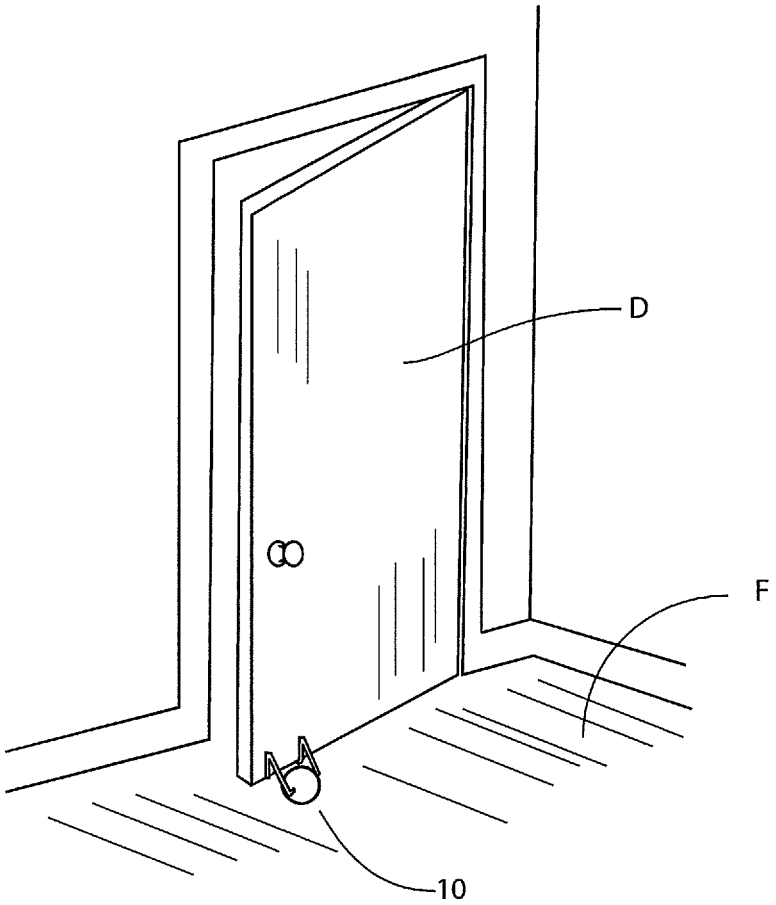
FIG. 1 is a perspective view showing a first embodiment of a door stay according to the invention, in position along the lower edge of the door, holding the door in a partially opened position.

In the attached drawings, like reference numerals designate corresponding elements throughout. Referring to FIG. 1, the invention will be seen to be illustrated there in the form of a door stay indicated generally by the reference numeral 10, shown positioned on a door referred to as "D", which is shown partially open.

Figure 2:
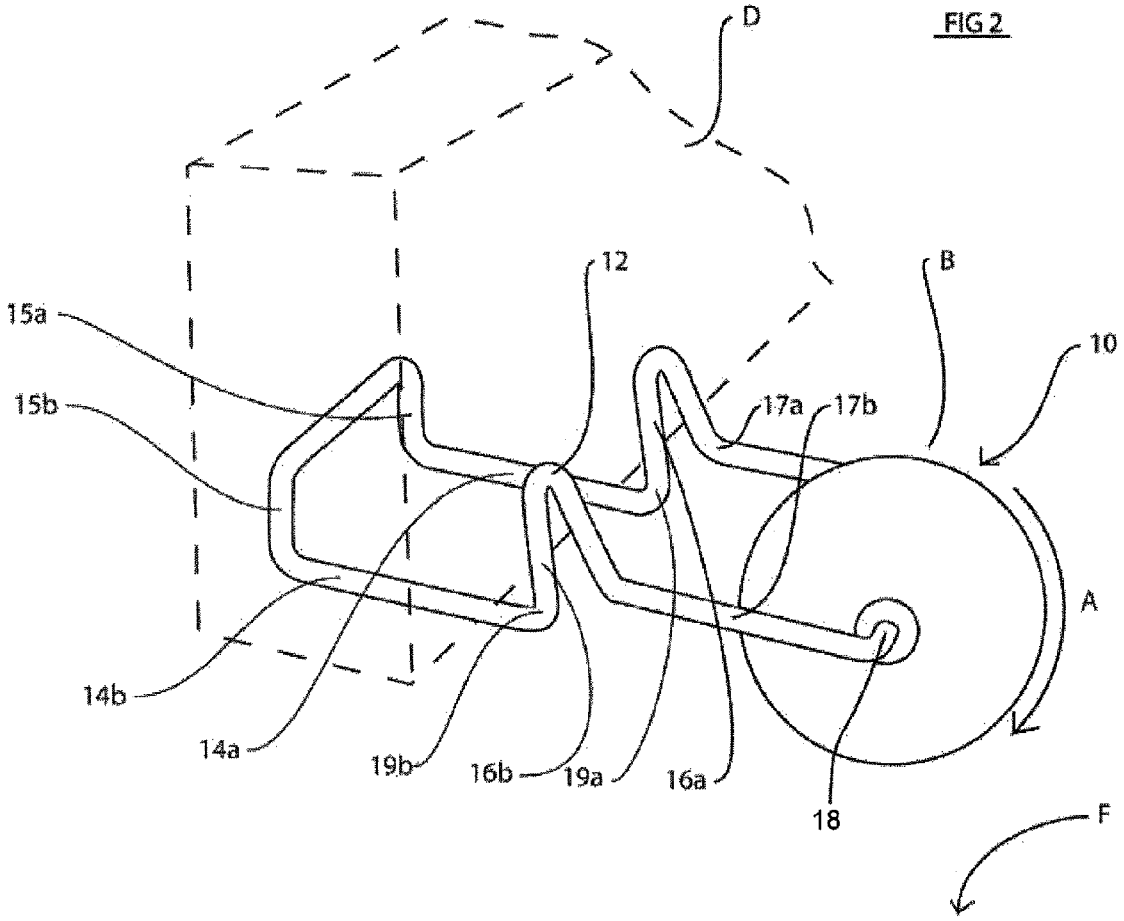
FIG. 2 is a greatly enlarged perspective view of the door stay of FIG. 1, showing a portion of the door in broken lines.

Referring to FIG. 2, in one embodiment, the door stay 10 preferably includes a mounting means 12. Preferably, the mounting means 12 is a continuous frame, formed of any suitable material, e.g., spring wire. The door stay 10 preferably also includes a floor contacting element, e.g., a ball "B", and the ball "B" is rotatably mounted on the frame 12. As will be described, when the frame 12 is clamped on the bottom of the door, the ball "B" is biased against the floor "F" because of the spring tension of the frame 12. The frame 12 in this case is shown in FIG. 2 secured to the lower edge of the door by means of being clamped by the connected spring frame members 16*a*/16*b*, 14*a*/14*b*, and 15*a*/15*b*. The frame 12 also extends out from the door, through member 17*a*/17*b* and forms an axle 18 about which the ball "B" is rotatable. The axle 18 passes through the middle hole of the ball "B". The ball "B" can rotate freely along the axle 18, e.g., as indicated by arrow "A" in FIG. 2.

Those skilled in the art would appreciate that the frame 12 and ball "B" can easily be manufactured and marketed as an inexpensive door stay. A further feature is that members 15*a*/15*b* and 14*a*/14*b* may be cut off and screws used at endpoint 19*a*/19*b* to surface mount the door stay 10 so that the ball "B" is biased by the frame 12 for engagement with the floor "F". The spring wire of the frame permits members 16*a*/16*b* to spread out away from member 15*a*/15*b* when member 14*a*/14*b* is preset for a 1-¾ inch thick door, and to collapse onto a thinner (e.g., 1-⅜ inch thick) door.

The ball "B" preferably is at least partially made of a resilient plastic or rubber material of medium or soft Shore hardness, so that it is adapted to compress somewhat in order to accommodate floor variations and to provide the desired degree of friction without damage to the floor. It will be understood that the invention is not limited to a specific material(s). Those skilled in the art would be aware of various suitable materials.

Figure 3:
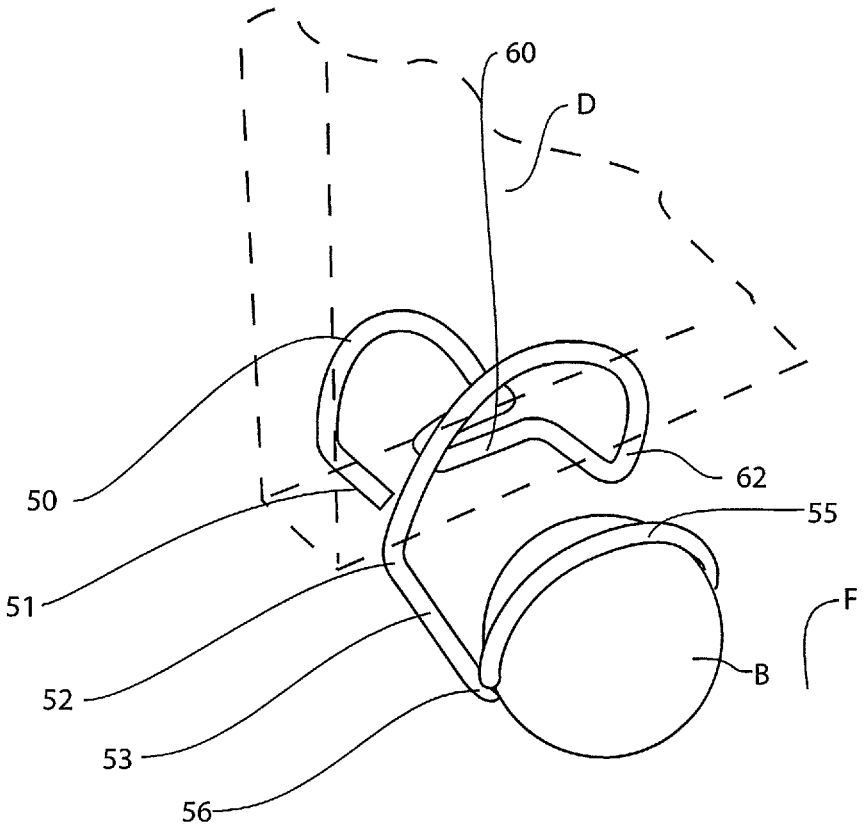
FIG. 3 is a perspective view, illustrating another embodiment of the invention.

In FIG. 3, door "D" and ball "B" are connected through the spring wire frame wire made up of back portion 51 bent under the door and meeting curved member 50, situated on the back side of the door "D", attached to a bent section of wire 60, continuing under the door "D", exiting from under the door and bent upward, to form a bend 52 and position the wire along the face of the door "D". Next the wire is bent 90 degrees perpendicular and away from the door, at another bend 53. It then is bent parallel to the door "D", forming the axle 56 to rotatably carry the ball "B". After protruding through the ball "B", the wire is bent upward and curved to form a curve 55 over the ball "B" to give the wire a finished appearance. The upward tension on ball "B" is transmitted through the axle 56, through the arm 53, to the curved wire section 52. This member twists about point 62, forcing bent section 60 in an upward direction. The position of the spring wire results in the center of these cumulative forces acting to push upward on the bottom of the door in reaction to the downward bias of the ball "B", giving a very solid hold on the action of the door stay. The ball "B" is urged against the floor "F" by the wire 60. The embodiment of the door stay illustrated in FIG. 3 also incorporates in its spring wire design, the ability of this door stop to adjust from 1-⅜ inch doors up to 2-inch doors, since the back member 50 is free to move under spring tension away from member 62, as member 60 spreads.

Figure 4:
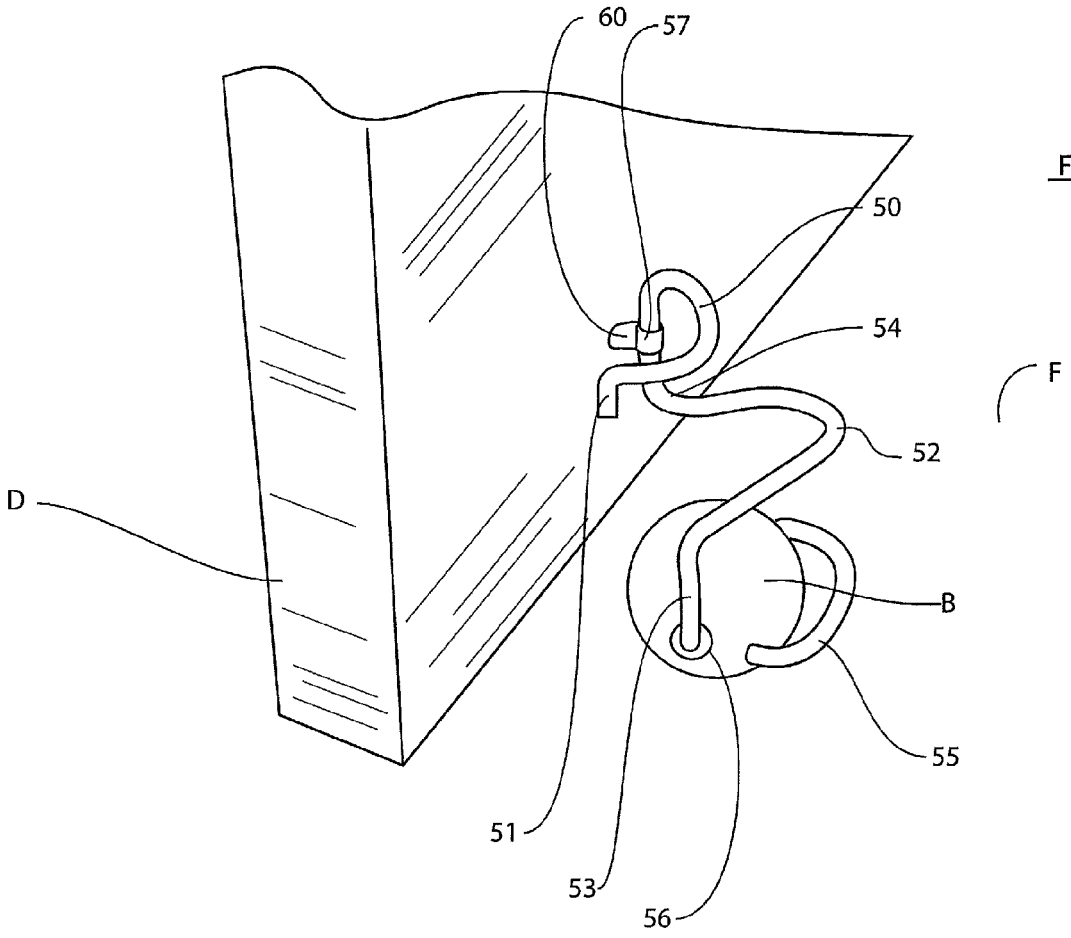
FIG. 4 is a perspective view showing the FIG. 3 embodiment installed in an alternative manner.

In FIG. 4, the embodiment of the door stay of FIG. 3 is shown turned vertically located with the ball under tension from the spring wire of the door stay frame, as described above. The curved door stay is attached with two screws 57 through frame member 60, and in this way may be used as inexpensive surface mount door stay. The arrangement illustrated in FIG. 4 may be used where it is undesirable to position the mounting means, in part, under a door.

Figure 5:
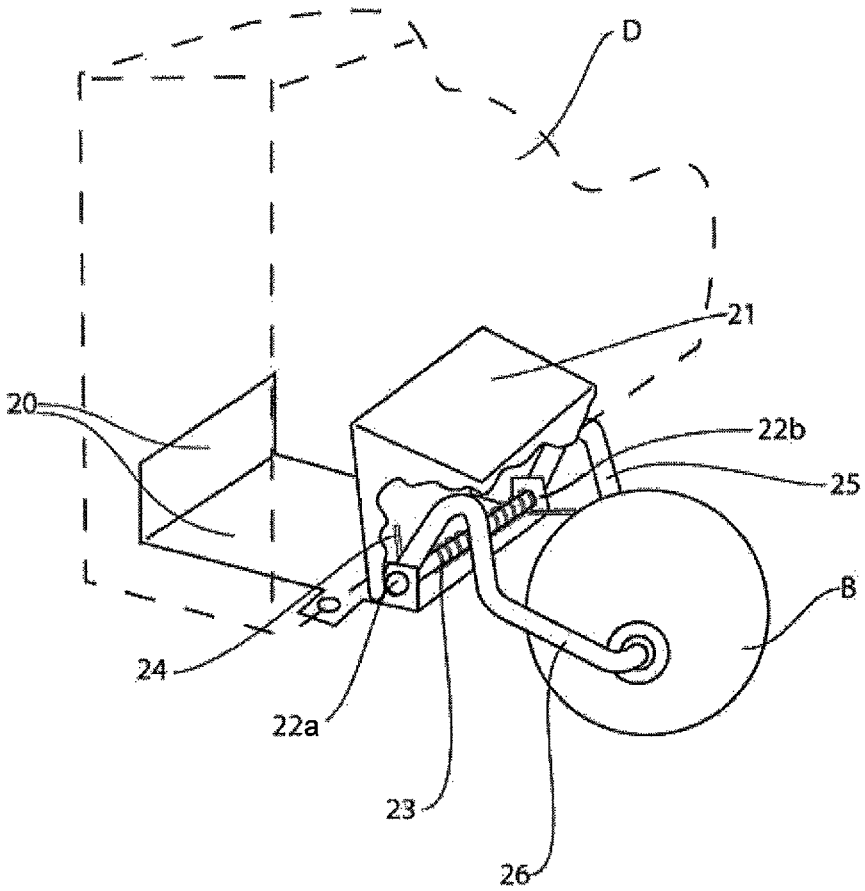
FIG. 5 is a perspective view of another embodiment of the invention, having an adjustable clamp with a ball spring-biased downwardly.

The door stay illustrated in FIG. 5 is mounted on the lower portion of door "D" and is clamped around the underside of door "D" through an adjustable member 20 to form a general clamp long enough to fit 1-¾ inch doors. However, the clamping angle is such that the clamp can close on 1-⅜ inches doors when clamped on the doors fitting between member 20 and second member 21. These pieces of the frame are pivoted through the hole in metal tab 22*a*/22*b*, attached member 20 and matching holes in second member 21. The shaft going through 22*a*/22*b* and pass through a spring 23 with one end 24 of the spring 23 tensioned against the inside of the second member 21. The other end of spring member 23 is loaded downward on member 25 which clamps the door and simultaneously tensions the ball against the floor to control the movement of the door "D", i.e., the ball is urged against the floor.

Figure 6:
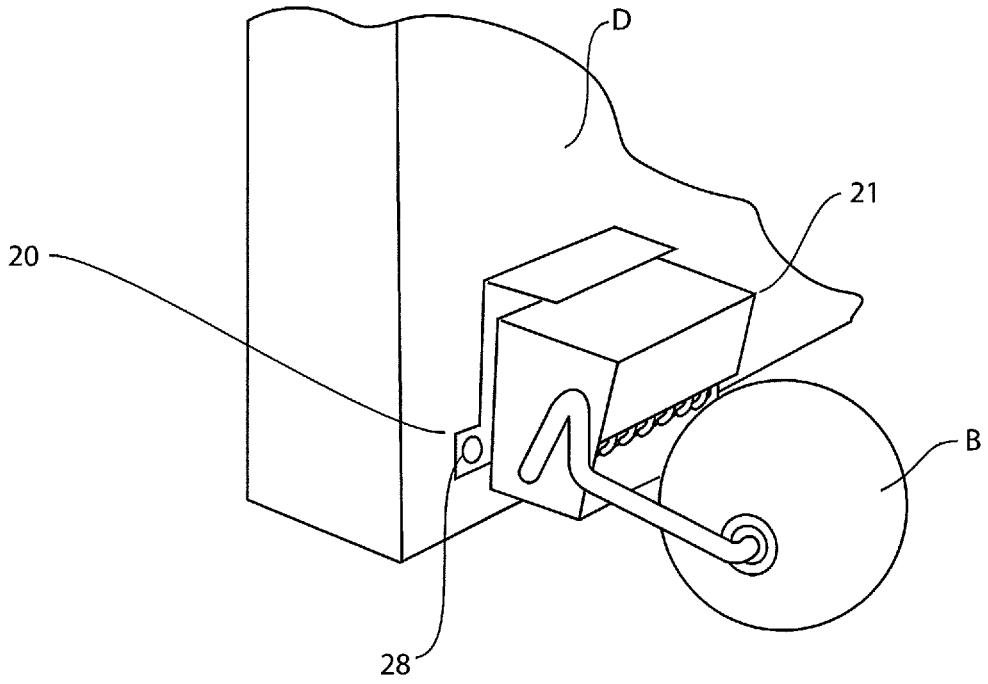
FIG. 6 is a perspective view of the embodiment of FIG. 5 installed in an alternative manner.

In FIG. 6, the clamping member 20 is rotated 90 degrees to an upper position at which point it may be located to adjust the tension with the floor and then fastened through tabs 28 with screws, so as to avoid the necessity of going under the door with clamp 20.

Figure 7:
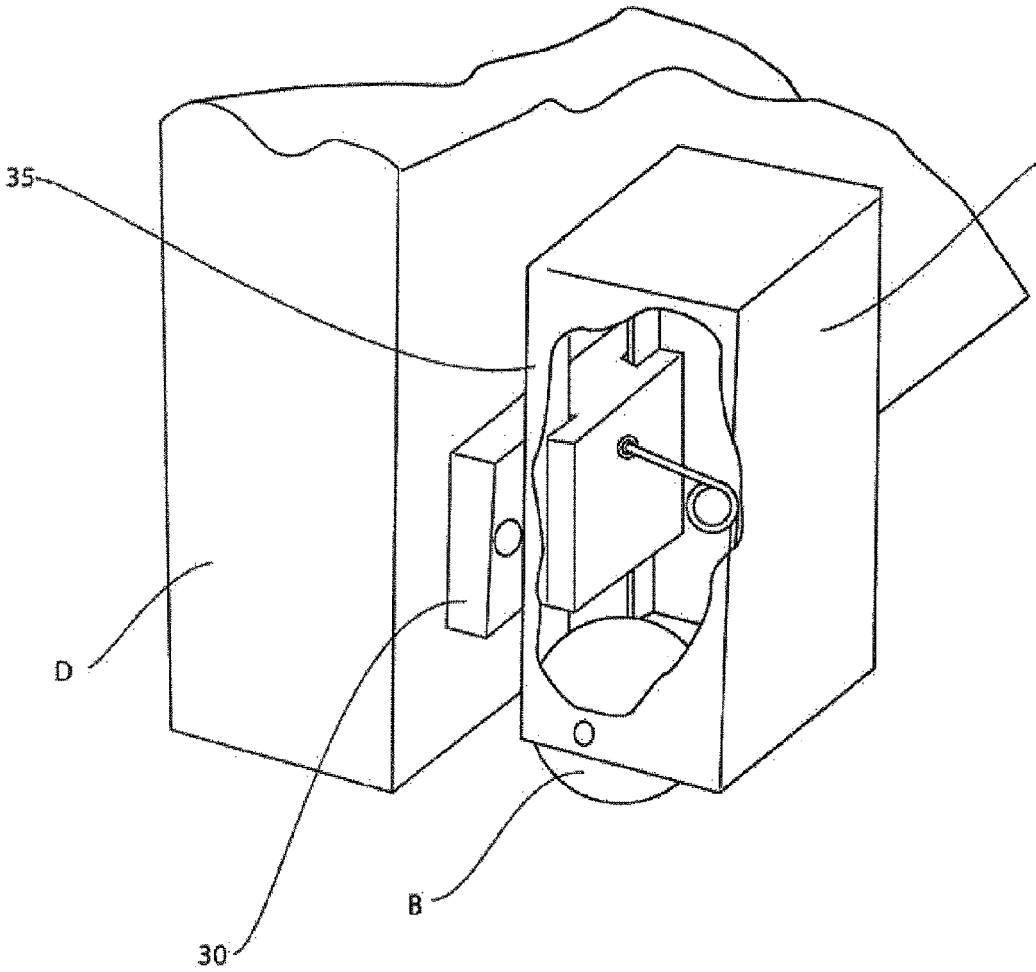
FIG. 7 is a perspective view of another embodiment, in which a first member is fastened to the door and forms a part of a holding channel, and a second member holds the tensioning ball.

In FIG. 7, this particular embodiment of the door stay has an attachment member 30 and a vertically moveable member 31. Members 30 and 31 form the two parts, male and female, of an interlocking channel 35 such that member 30 is loaded to achieve downward tension on member 31, which can be increased by lowering the mounting position of member 30 on door "D". The depth of movement and stability of member 31 is a variable design criterion.

Figure 8:
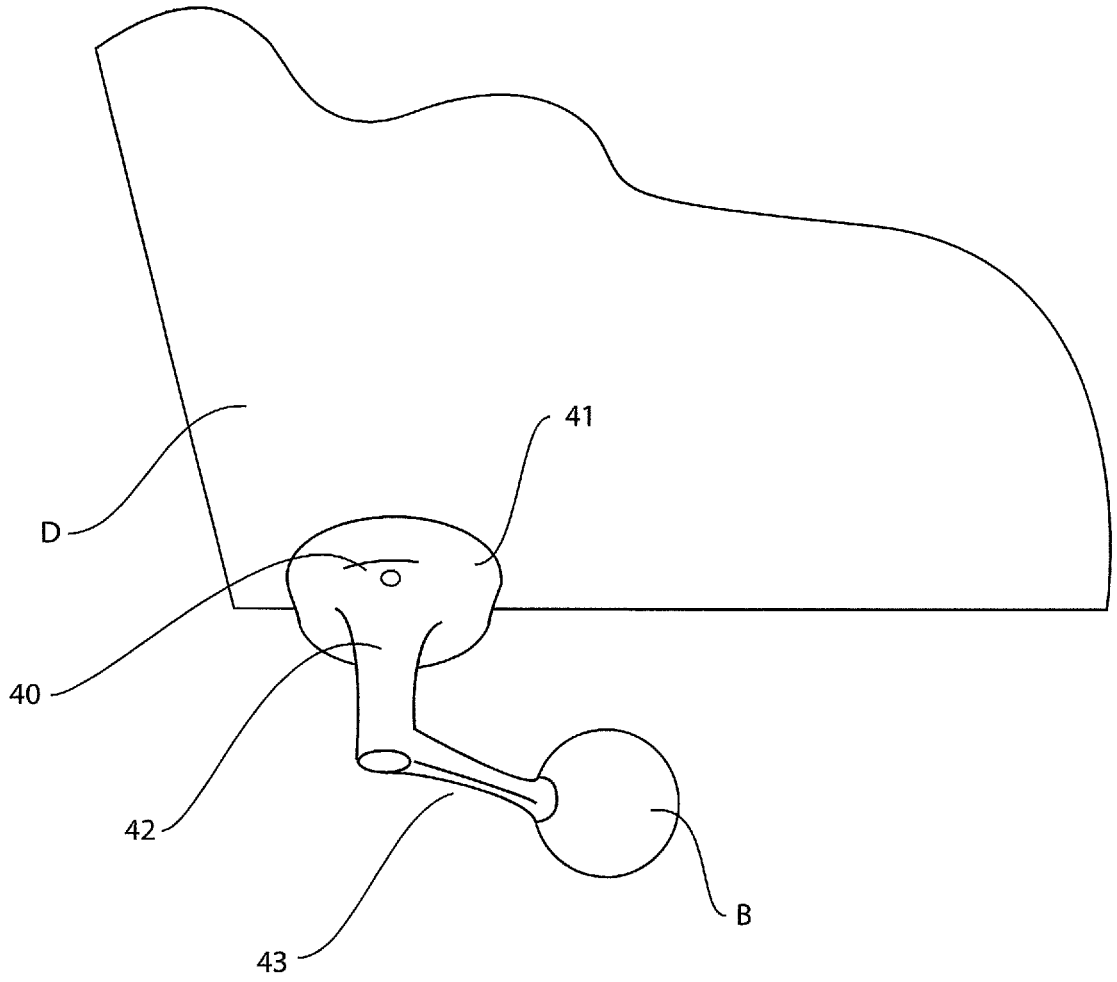
FIG. 8 is a perspective view of another embodiment.

In FIG. 8, the door stay by its design allows for maximum vertical movement and thereby adjusting to the slope and rough contours of the floor covering while maintain proper tension at all points in its travel with the door. The door stay is mounted through the back plate 41 into the face of door "D". The back plate 41 holds an axle 42, perpendicular to door "D" and holds the arm 43. The ball "B" has an axle (not shown) in the middle of the ball, The ball can rotate freely along the axle. And the axle is screwed into the end of arm 43. The arm 43 is spring loaded (not shown) between the back plate 41 along the axle of the ball "B" and creates tension between door "D" and the floor covering. The structure of spring of the arm 43 is not shown in the figure, but it could be any form, for example, it could be a spring-mounted along the arm 43.

Figure 9:
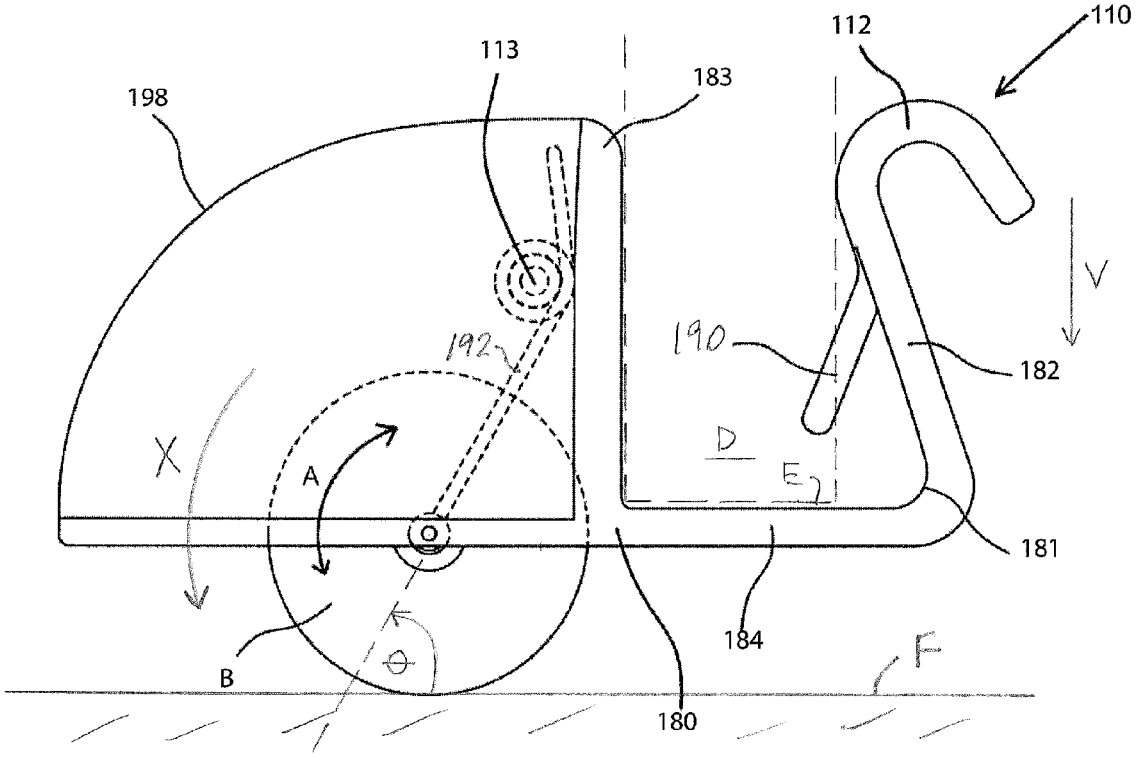
FIG. 9 is a front view of another embodiment of the invention.
Figure 10:
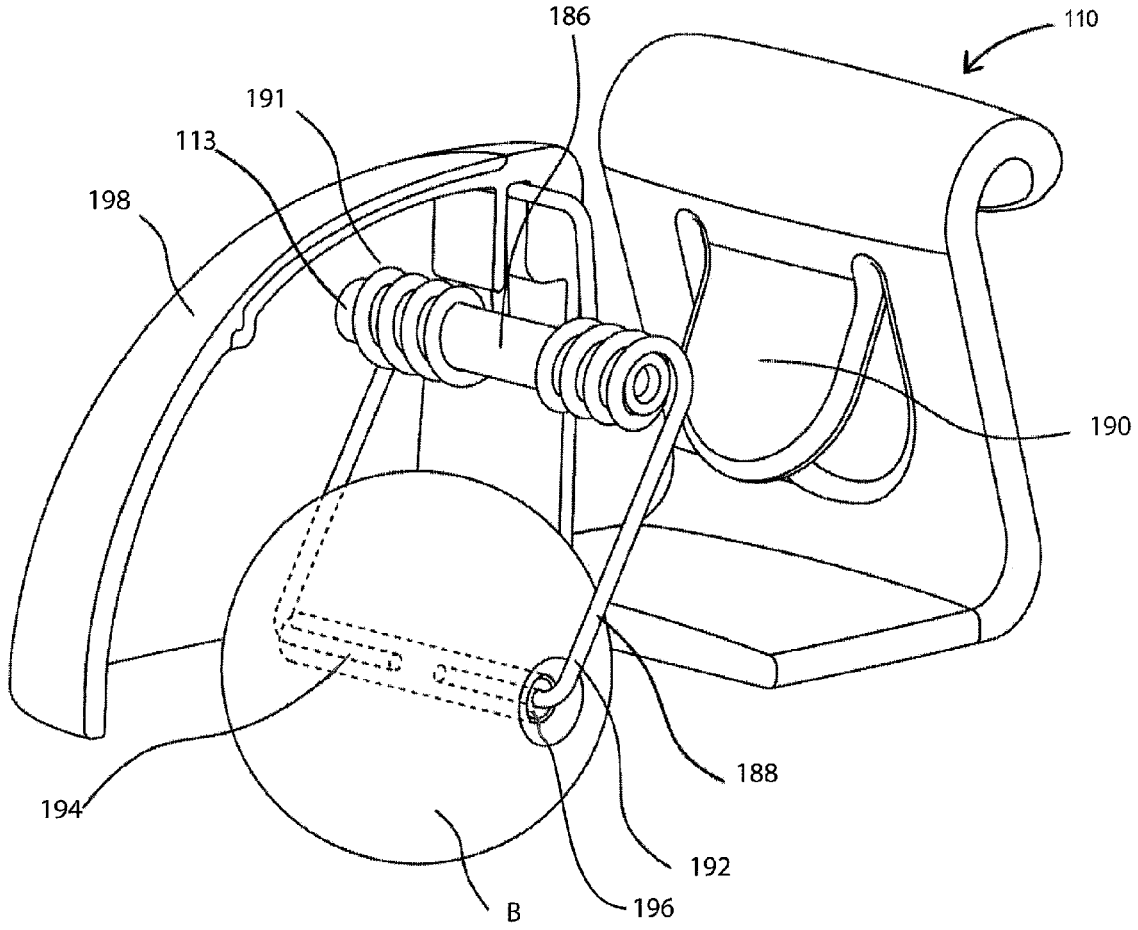
FIG. 10 is a cross sectional side view of the embodiment of FIG. 9.
Figure 11:
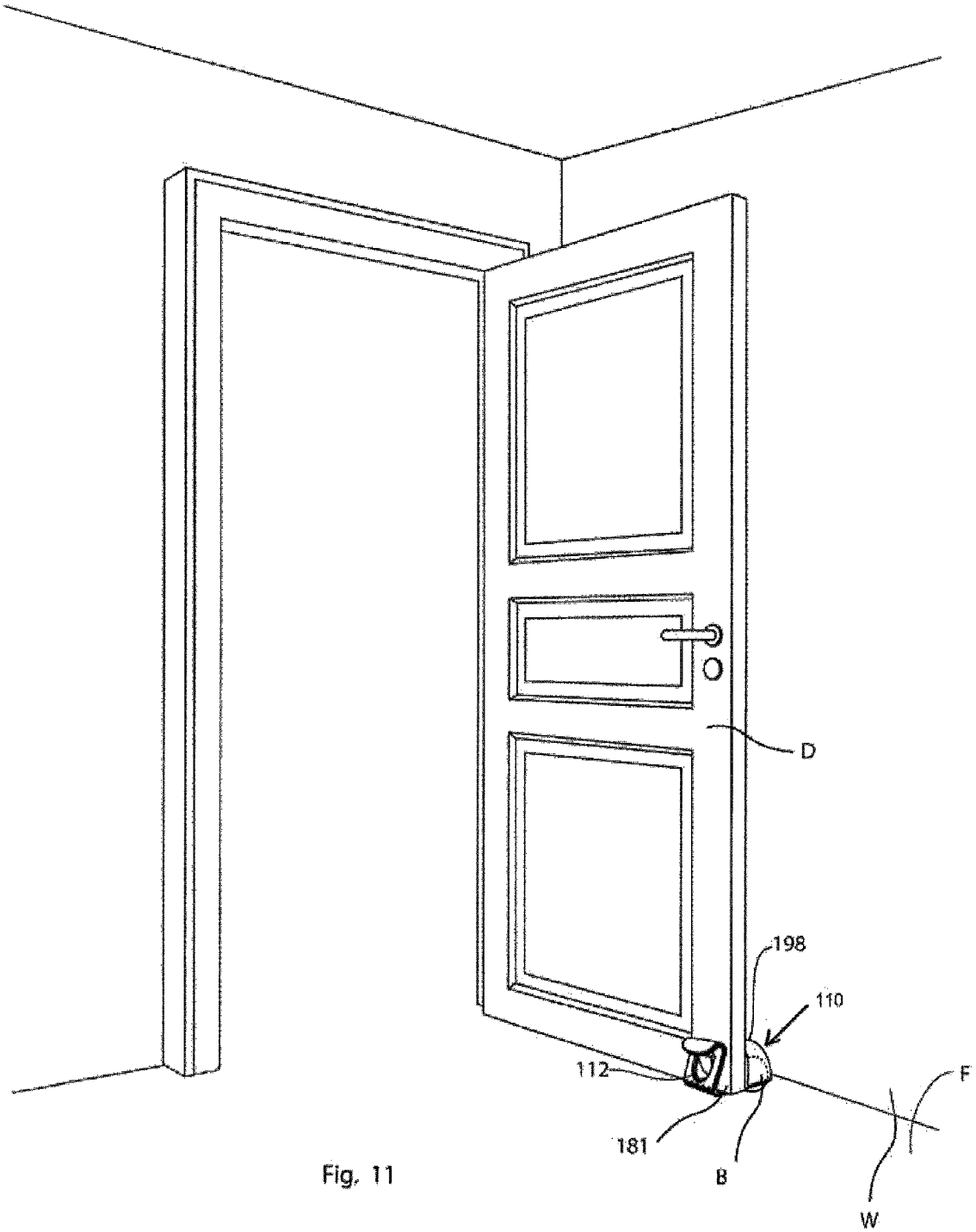
FIG. 11 is a perspective view of another alternative embodiment of the door stay of the invention.

Another embodiment of the door stay 110 is shown in FIGS. 9-11. Preferably, the door stay 110 is for attachment to the door "D" above the floor "F". In one embodiment, the door stay 110 preferably includes a mounting means 112 and a floor-contacting element (i.e., a ball "B") rotatably mounted on the mounting means 112. As will be described, the floor-contacting element preferably is biased against the floor "F" by the mounting means 112.

As can be seen in FIGS. 9 and 11, the mounting means 112 is attachable to the door "D". The mounting means 112 holds the ball "B" and pushes the ball down against the floor "F", i.e., the ball "B" is urged against the floor by the mounting means 112, in the direction indicated by arrow "X" in FIG. 9. Preferably, the ball "B" is rotatable relative to the mounting means 112. It will be understood that the door "D" is illustrated in broken lines in FIG. 9 for clarity of illustration.

Preferably, the mounting means 112 includes a frame 180 and spring subassembly 113. The frame 180 includes a U-shaped clamp 181. With the U-shaped clamp 181, the door stay 110 can be clamped at the bottom of a door. The U-shaped clamp 181 includes a first plate 182 and a second plate 183 which are connected by a bottom plate 184. The first plate 182 of the U-shaped clamp 181 is angled inwardly, therefore, the distance of the upper opening of the U-shaped clamp 181 is slightly smaller than that of the bottom part. Preferably, the first or both plates of the U-shaped clamp are flexible, therefore, the U-shaped clamp 181 can be clamped around the underside of the lower portion of a door. Since the U-shaped clamp 181 is made of flexible material, the door stay 110 can be clamped to doors with a wide range of thicknesses while providing adequate clamping force to maintain constant pressure between the floor-contacting element and the floor.

Additional flexible fins 190 can also be provided on one of plates of the U-shaped clamp 181. The fins 190 are positioned to a point downwardly and inwardly, therefore, when the U-shaped clamp 181 is clamped on the door, one end of the fin 190 is pressed against the surface of the door, which increases the clamping force for keeping the door stay 110 attached to the door. For clarity of illustration, the fin 190 is shown in FIG. 9 in a position it is in when not engaged with the door "D". It will be understood that, when the fin 190 is engaged with the door "D", the fin 190 is bent.

The U-shaped clamp 181 can be made of any suitable material, e.g., different kinds of flexible materials, e.g., suitable plastics or metal. ABS (acrylonitrile butadiene styrene) is preferred since it can sustain force and it is sufficiently flexible to be attached to doors of different thickness. Even though the first plate, the second plate and the bottom plate are mentioned here, the U-shaped clamp 181 can be unitary, i.e., made of a single piece. The clamp can be integral generating the clamping force from the properties of its material. Or the clamp can be constructed out of several parts using one or more springs to achieve the desired clamping force. The plates could also have embossments (not shown) that provide sufficient clamping grip.

The spring subassembly 113 holds the ball "B" and presses the ball "B" against the floor. The spring subassembly 113 preferably includes a shaft 186 and a spring portion 188. The shaft 186 is fixed on the frame 180. The spring portion 188 includes a coil portion 191, arms 192 and axle elements 194. The coil portion 191 is mounted on the shaft 186. Each of the two ends of the coil portion 191 is connected with one end of each arm 192 respectively, and the other end of each arm 192 inserts respectively into one of two holes on both ends of an axle channel 196. The axle channel 196 goes through the ball "B" and the ball "B" is held by the axle elements 194 of the spring portion 188. In this way, the ball "B" rotates about the axle elements 194 (in the direction indicated by arrow "A", as shown in FIG. 9). It will be understood that the coil portion 191, acting upon the ball "B" through the arms 192 and the axle elements 194, urges the ball "B" against the floor "F".

When the door stay 110 is clamped on the underside of the lower portion of the door "D" by the U-shaped clamp 181, the ball "B" engages the floor "F" and is supported by the floor "F". Accordingly, the axle channel 196 is positioned at a preselected height above the floor "F". The axle elements 194 are positioned at substantially the preselected height above the floor, lifting the lower ends of the arms 192 and subjecting the coil portion 191 to twisting (i.e., torque) due to the lower ends of the arms 192 being urged upwardly. In reaction to this, the coil portion 191 resists the twisting thereof, i.e., the coil portion 191 urges the ball "B" against the floor "F". The friction between the ball "B" and the floor "F" caused by the spring force of the coil portion 191 prevents the door from swinging.

Those skilled in the art would appreciate that the mounting means 112 is attachable to the door "D" over a limited range of vertical positions. For instance, as can be seen in FIG. 9, the door "D" may be positioned with a lower edge "E" thereof engaged with the bottom plate 184. When the door "D" is in this position, i.e., the lowest position it can be in relative to the mounting means 112, the shaft 186 is at the highest height possible relative to the floor "F". In this position, the angle $\Theta$ defined between the arms 192 of the spring portion 188 and the floor "F" is the largest angle possible. Accordingly, those skilled in the art would appreciate that, when the door "D" is in the lowest position possible relative to the mounting means 112, the spring subassembly 113 urges the ball "B" against the floor "F" with the lowest force. This lower force means that there is lower frictional resistance to movement of the ball "B" relative to the floor "F".

It will be understood that, to adjust the force urging the ball "B" against the floor "F", the mounting means 112 may be positioned lower relative to the door "D", i.e., the mounting means 112 may be moved in the direction indicated by arrow "V" (FIG. 9) relative to the door "D". When the mounting means 112 is positioned lower relative to the door "D", the shaft 186 is lower, so that the angle $\Theta$ defined between the arms 192 and the floor is smaller. In this situation, the ball "B"

is urged against the floor "F" with greater force. Because the force urging the ball "B" against the floor "F" is greater, the ball "B" encounters greater frictional resistance to its movement relative to the floor "F". Accordingly, from the foregoing it can be seen that the biasing of the floor-engaging element against the floor (i.e., the extent to which the ball "B" is urged against the floor) is adjustable, and the extent of frictional resistance to movement of the floor-engaging element relative to the floor is also adjustable.

Since the tension of the spring portion 188 is limited, when the door is swung open, the friction between the ball "B" and the floor "F" is less than the force to which the door is subjected to open it, and the door can be opened and partially closed at any angle.

Since the ball "B" is able to roll along the floor, it does not damage the floor while the door is forced open or closed. The design of the spring portion 188 makes it possible for the door stay 110 being used with any door regardless of the gap between the door and the floor, over a wide range.

The ball "B" preferably is made of a resilient plastic or rubber material, so that it may be compressed somewhat in order to accommodate floor variations and to provide the desired degree of friction without damage to the floor. The material can be chosen by person skilled in the art with routine experimentation.

As mentioned before, the ball may have any suitable form. It may be any rotatable object that can be attached to the axle elements 194 and rotated thereabout.

Optionally, a cover 198 can also be provided to cover and protect the ball "B". The cover 198 can be integral with the U-shaped clamp or a secondary part attached to the clamp. As showing in FIGS. 10-11, the cover 198 preferably is extended from the second plate 183. Those skilled in the art would appreciate that the cover 198 may have a variety of shapes.

With the design of the cover, the door stay can also work as a door stop. As showing in FIG. 11, when the door "D" is opened fully, the cover 198 of the door stay is against the wall and prevents the door "D" from hitting the wall "W". In order to protect the door stay 110 and the wall "W", the cover 198 can be made by flexible material, like rubber.

The invention provides significant advantages in the positioning of a door so that it will not swing to and fro, but can still nevertheless be swung open when desired by manual operation of the door. The door stay is attachable to the lower edge of a door and removable when desired. These features are provided with the mounting means, which, because it urges the ball against the floor, permits the ball to follow the contour of the floor adjusting to various angles between the floor and door as the ball travels and remains capable of holding the door in place against limited forces, such as the wind. The use of a ball as the engagement member with the floor contour compensates for frictional disadvantages of other engagement appliances.

This is presented with the understanding that the channel may be incorporated in various forms. The invention provides significant advantages in the positioning of a door so that it will not swing to and fro, but which can still nevertheless be swung open when desired by manual operation of the door. The door stay is attachable to the lower edge of the door, wherever required and removed when no longer required, or when it is required somewhere else. All of these features are provided in a relatively simple low cost door stay which is highly effective in practical use.

The foregoing is a description of preferred embodiments of the invention which are given here by way of examples. The invention is not to be taken as limited to any of the specific features as described, but comprehends all such variations thereof as come within the scope of the appended claims. Different materials may be used, and wheels or ball bearings could be used in place of the ball, though the ball is preferred.

Any features referred to in the claims and not expressly described in the preceding are hereby incorporated by reference in this description.

We claim:

1. A door stay for attachment to a door above a floor, the door stay comprising a mounting means and a floor-contacting element, wherein the mounting means includes a frame and a spring subassembly, the spring subassembly includes a shaft fixed on the frame and a spring portion, and the spring portion includes a coil portion fixed on the shaft, two arms and axle elements, and wherein the floor-contacting element is rotatably mounted on the axle elements and biased against said floor by the spring subassembly.

2. A door stay as in claim 1, wherein the floor-contacting element is a ball of resilient thermoplastic material.

3. A door stay as in claim 2, wherein the frame comprises a U-shaped clamp that is attachable to the door over a range of vertical positions, and said biasing of said floor-contacting element against said floor is adjustable by the vertical positioning of the U-shaped clamp, whereby the extent of frictional resistance to movement of the floor-contacting element relative to said floor may be adjusted.

4. A door stay as in claim 1, wherein the frame comprises a U-shaped clamp that is attachable to the door over a range of vertical positions, and said biasing of said floor-contacting element against said floor is adjustable by the vertical positioning of the U-shaped clamp, whereby the extent of frictional resistance to movement of the floor-contacting element relative to said floor may be adjusted.

5. A door stay as in claim 1, additionally comprising a cover that partially covers the floor-contacting element.

* * * * *